US005733106A

United States Patent [19]

Lee

[11] Patent Number: 5,733,106

[45] Date of Patent: Mar. 31, 1998

[54] SUCTION MUFFLER FOR A RECIPROCATING COMPRESSOR WITH EXTERNAL HOLES TO REDUCE NOISE ATTENUATION

[75] Inventor: Sung-Tae Lee, Suwon, Rep. of Korea

[73] Assignee: Samsung Electronics Co., Ltd., Suwon, Rep. of Korea

[21] Appl. No.: 688,671

[22] Filed: Jul. 29, 1996

[30] Foreign Application Priority Data

Jul. 29, 1995 [KR] Rep. of Korea ..... 95-23136

[51] Int. Cl.[6] ..... F04B 39/00

[52] U.S. Cl. ..... 417/312; 417/902; 181/270; 181/264; 181/403; 62/296

[58] Field of Search ..... 417/312, 902; 181/403, 272, 270, 268, 264; 62/296

[56] References Cited

U.S. PATENT DOCUMENTS

| | | | |
|---|---|---|---|
| 3,864,064 | 2/1975 | Gannaway | 417/312 |
| 4,370,104 | 1/1983 | Nelson et al. | 417/312 |
| 4,401,418 | 8/1983 | Fritchman | 417/312 |
| 4,784,581 | 11/1988 | Fritchman | 417/312 |
| 4,960,368 | 10/1990 | Lilie | 417/312 |
| 5,328,338 | 7/1994 | Hirano et al. | 417/312 |
| 5,496,156 | 3/1996 | Harper et al. | 417/312 |
| 5,542,824 | 8/1996 | Sung-Tae Lee | 417/312 |

*Primary Examiner*—Timothy Thorpe
*Assistant Examiner*—Cheryl J. Tyler
*Attorney, Agent, or Firm*—Burns, Doane, Swecker & Mathis, L.L.P.

[57] ABSTRACT

A reciprocating compressor includes a cylinder block disposed in a chamber formed by a casing. A piston is mounted for reciprocation in a bore of the cylinder block. A valved cylinder head is disposed at an end of the bore. The cylinder head conducts sucked fluid to the bore. The sucked fluid enters the casing through an inlet therein and travels through a suction passage formed by a suction muffler and then through a base muffler before entering the cylinder head. The suction muffler includes exterior holes for communicating the suction passage of the suction muffler with the chamber of the casing, to thereby reduce the suction load occurring at the bore and valve plate.

6 Claims, 10 Drawing Sheets

SUCTION MUFFLER FOR A RECIPROCATING COMPRESSOR WITH EXTERNAL HOLES TO REDUCE NOISE ATTENUATION

BACKGROUND OF THE INVENTION

1. Field of the Invention

The present invention relates to a compressor for compressing to high pressure a refrigerant supplied from an evaporator, and to a suction muffler employed in such a compressor.

2. Description of the Prior Art

A conventional compressor has been mainly used for a cooling device such as a large volume compressor and the like. The compressor is usually activated by an electric motor hermetically sealed in a casing.

Typically, two dome-shape casing segments are mutually connected to encompass a sphere-shaped volume containing a motor and a compressing mechanism.

Suction gas usually passes through a housing before communicating with the ports and chambers guided into compressing mechanism.

A prior art compressor, is disclosed in Korean Patent application No. 94-9295 filed on Apr. 29, 1994 by the present inventor.

The Korea Patent application No.94-9295, as illustrated in FIG. 1, includes a body 50*a*, a crankshaft 53*a* disposed in the body 50*a*, a connecting rod 54*a* for converting a rotating motion of the crankshaft 53*a* to reciprocating motion, a piston 55*a* for being reciprocated by the connecting rod 54*a*, a cylinder block 60*a* for guiding the piston 55*a* to perform a reciprocating motion, a valve plate 56*a* for being fixedly secured to the cylinder block 60*a* and for being formed with a suction inlet and a discharge outlet, and a suction muffler 10*a* for attenuating noise generated by the refrigerant supplied from the suction inlet of the valve plate 56*a*.

The cylinder head 30*a* as illustrated in FIGS. 1 and 2 is fixedly secured to the valve plate 56*a* and is formed at an inner surface thereof with a concaved recess 32*a* and a mounting chamber 31*a*.

Between the cylinder head 30*a* and the suction muffler 10*a*, there is disposed a base muffler 20*a*, which in turn serves to inhibit the amount of refrigerant being transferred from the cylinder head 30*a* to the cylinder block 60*a* to thereby restrain a volumetric increase of the refrigerant and at the same time to guide a flow of the refrigerant having passed the suction muffler 10*a*.

Meanwhile, reference numeral 40*a* in FIG. 2 is a capillary tube.

In the conventional compress, or thus constructed, the refrigerant from an evaporation (not shown) is supplied into the cylinder block 60*a* through the base muffler 20*a* and the suction muffler 10*a* to thereby be compressed by reciprocating motion of the piston 55*a*.

At this time, the suction muffler 10*a* is over-vacuumized therein, so that, when the piston 55*a* is moved toward an arrowhead direction A shown in FIG. 1 in order to suck-in the refrigerant, an excessive electric power is consumed.

In other words, an excessive power is needed to activate the piston 55*a*, thereby causing an over-load to the piston 55*a*.

When an excessive load is on the piston 55*a*, the crankshaft 53*a* connected to the piston 55*a* is also excessively loaded, thereby reducing a compressing efficiency of the refrigerant and reducing the reliability of the product as well.

Furthermore, because the suction muffler 10*a* is completely vacuumized, a suction inlet (not shown) formed at the valve plate 56*a* is closed before the piston 55*a* reaches a bottom dead center, thereby preventing more refrigerant from being sucked into the cylinder block 60*a* and reducing the compressing efficiency.

In other words, there are lots of problems in the conventional compressor, in that the suction muffler 10*a* becomes excessively vacuumized during an intake stroke thereof, producing an excessive load on the piston 55*a* and the crankshaft 53*a* and closing the suction inlet of the valve plate 56*a* at an earlier time, so that the compressing efficiency of the compressor is decreased and reliability of the product deteriorates.

SUMMARY OF THE INVENTION

The present invention is therefore disclosed to solve the aforementioned problems and it is an object of the present invention to provide a compressor which can prevent a piston, a crankshaft and the like from being excessively loaded during an intake stroke thereof and at the same time, prevent a suction inlet from being closed at an earlier time, so that a compressing efficiency of the compressor can be improved and a reliability of the product can be enhanced.

In accordance with the object of the present invention, there is provided a compressor, the compressor having a crankshaft for performing a rotary movement, a piston for being reciprocated by the rotary movement of the crankshaft, a cylinder block for guiding the piston to be reciprocated, a cylinder head for being mounted at the cylinder block and for being formed with a discharge chamber, a valve plate for being disposed between the cylinder head and the cylinder blocked and for being formed with a suction inlet, and a base muffler for being partially inserted into the cylinder head to thereby inhibit non-volumetric increase of the refrigerant and to guide flow of the refrigerant, comprising:

a suction muffler formed with more than one external hole, the suction muffler being coupled to the base muffler for preventing excessive load on the piston and the crankshaft during an intake stroke and for preventing a suction inlet formed at the valve plate from being early closed.

BRIEF DESCRIPTION OF THE DRAWINGS

A fuller understanding of the nature and objects of the invention, reference should be made to the following detailed description taken in conjunction with the accompanying drawings in which.

DETAILED DESCRIPTION OF PREFERRED EMBODIMENTS OF THE INVENTION

Now, the preferred embodiments of the present invention will be described in detail with reference to the accompanying drawings.

Figure 1:
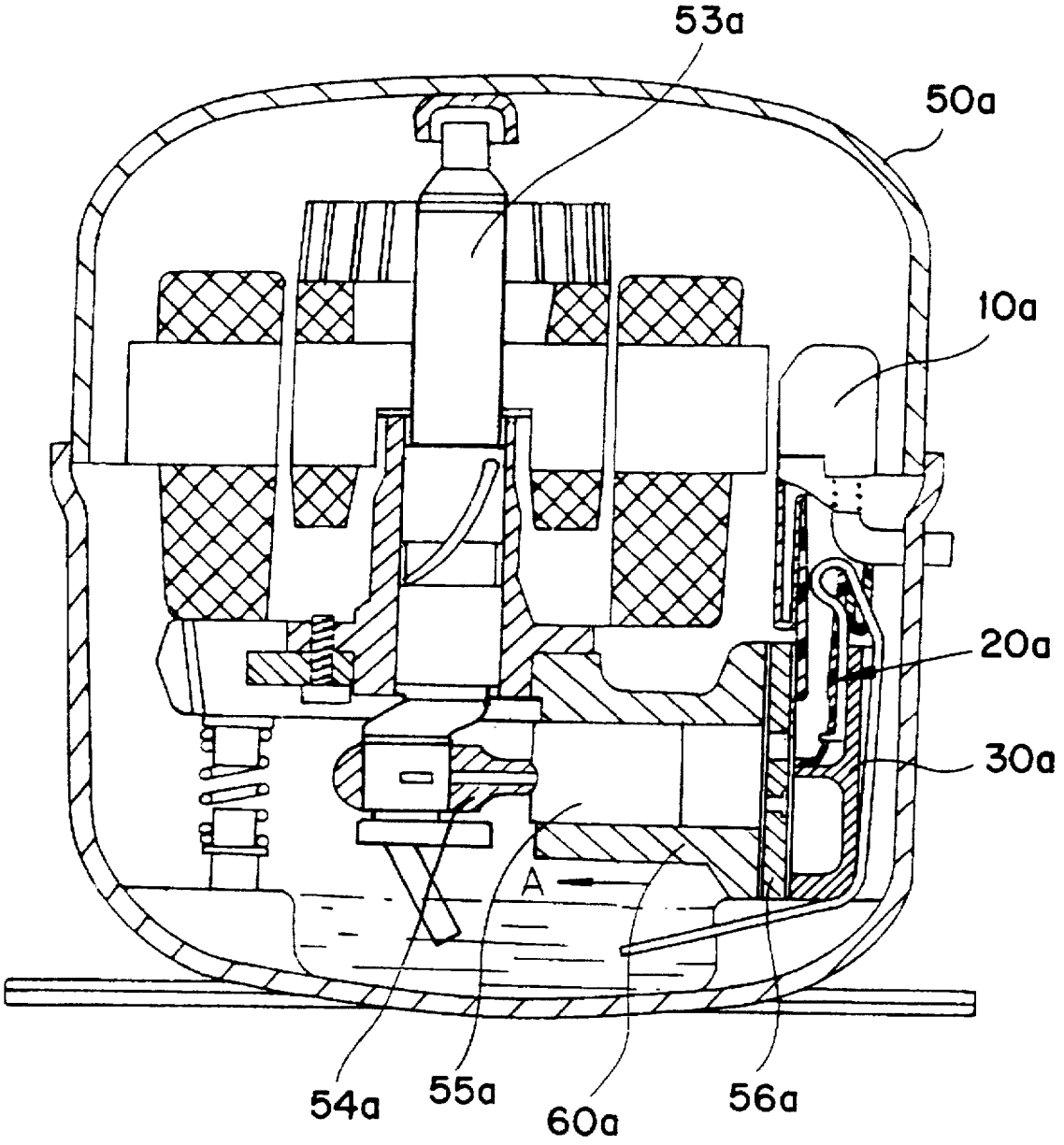
FIG. 1 (PRIOR ART)
FIG. 1 is a sectional view for schematically illustrating an inner structure of a compressor according to the prior art.
Figure 2:
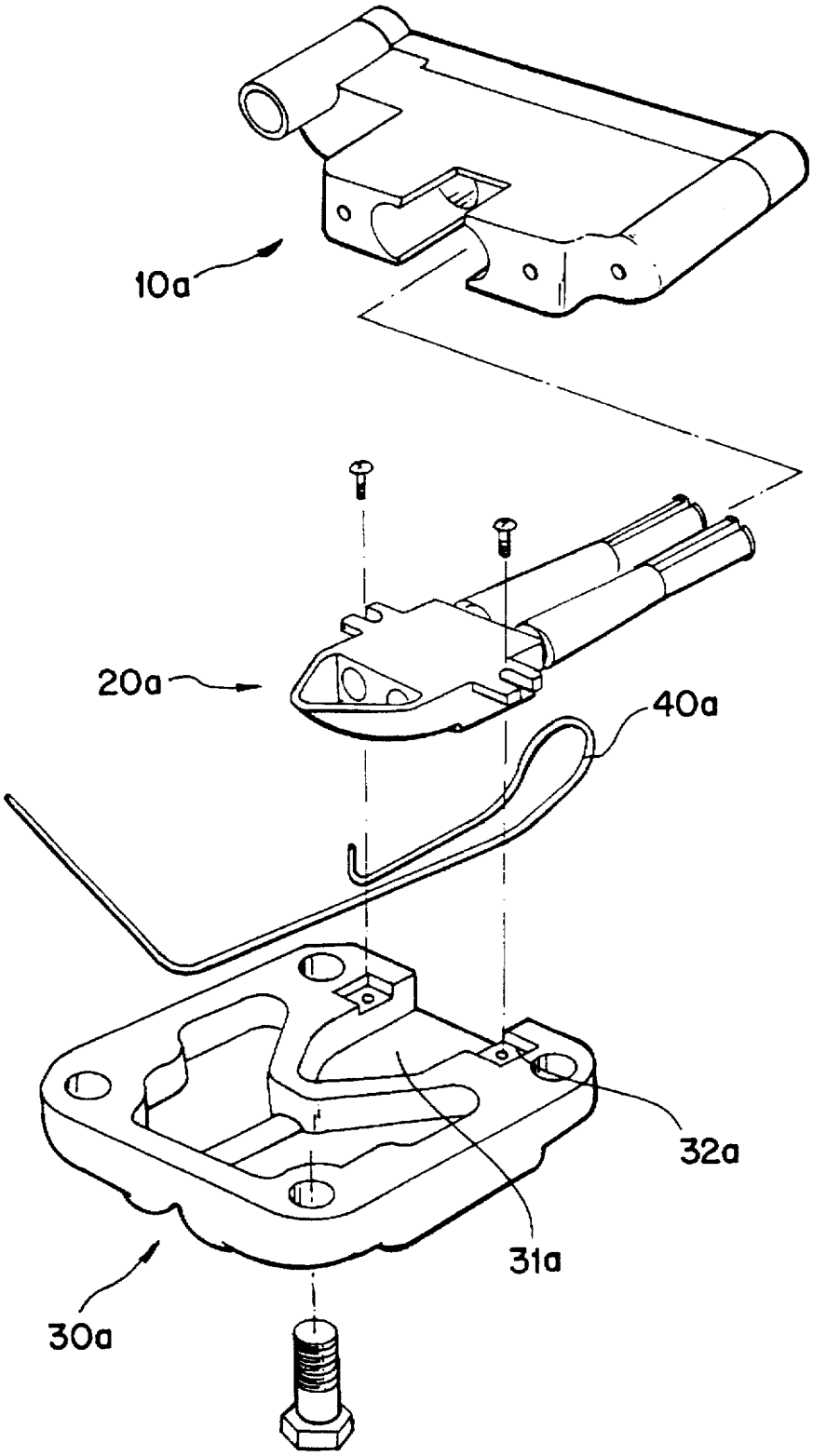
FIG. 2 (PRIOR ART)
FIG. 2 is an exploded perspective view for illustrating exploded principal parts of a compressor according to the prior art.
Figure 3:
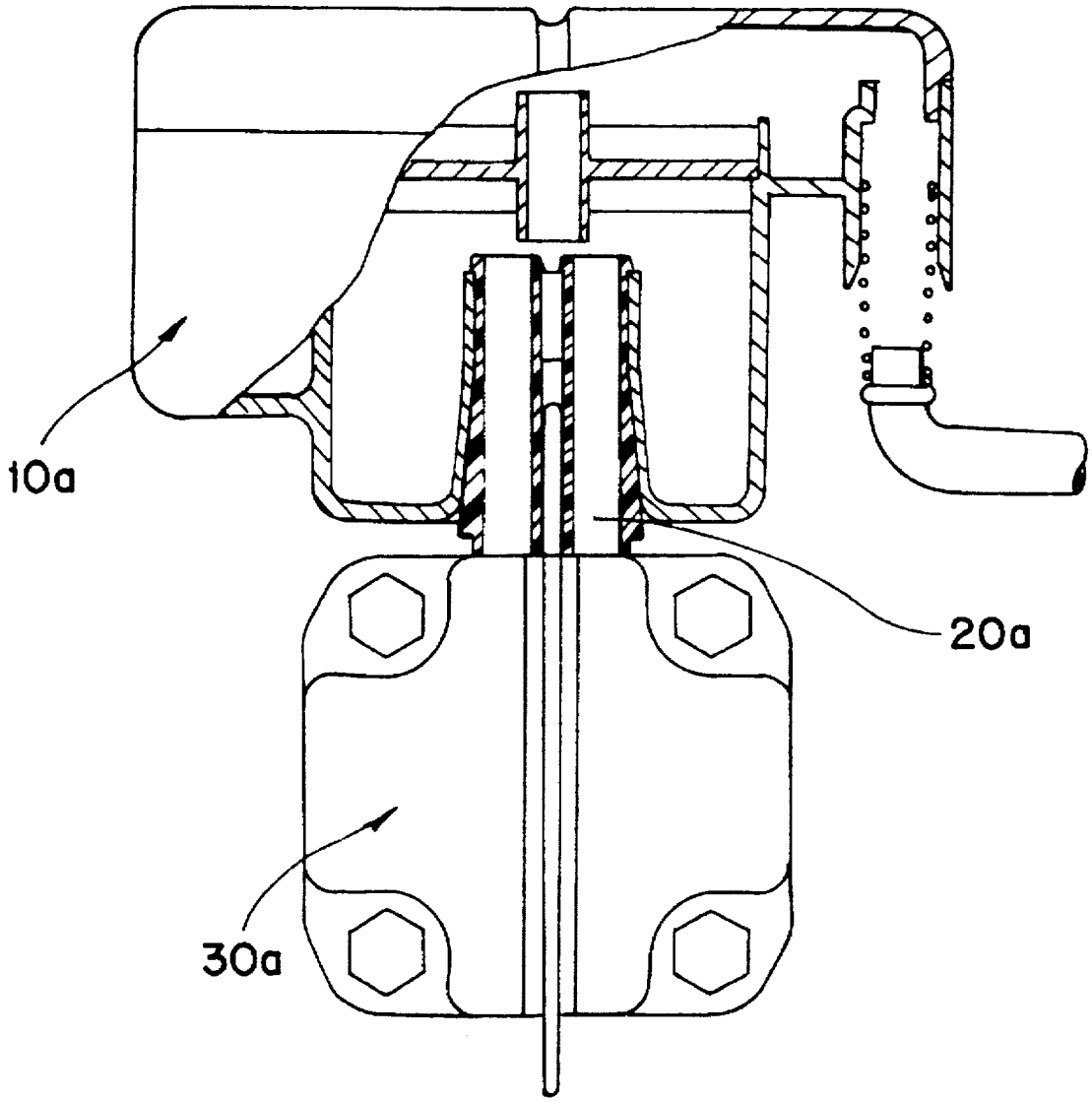
FIG. 3 (PRIOR ART)
FIG. 3 is a sectional view for illustrating an inner structure of principal parts according to the prior art.
Figure 4:
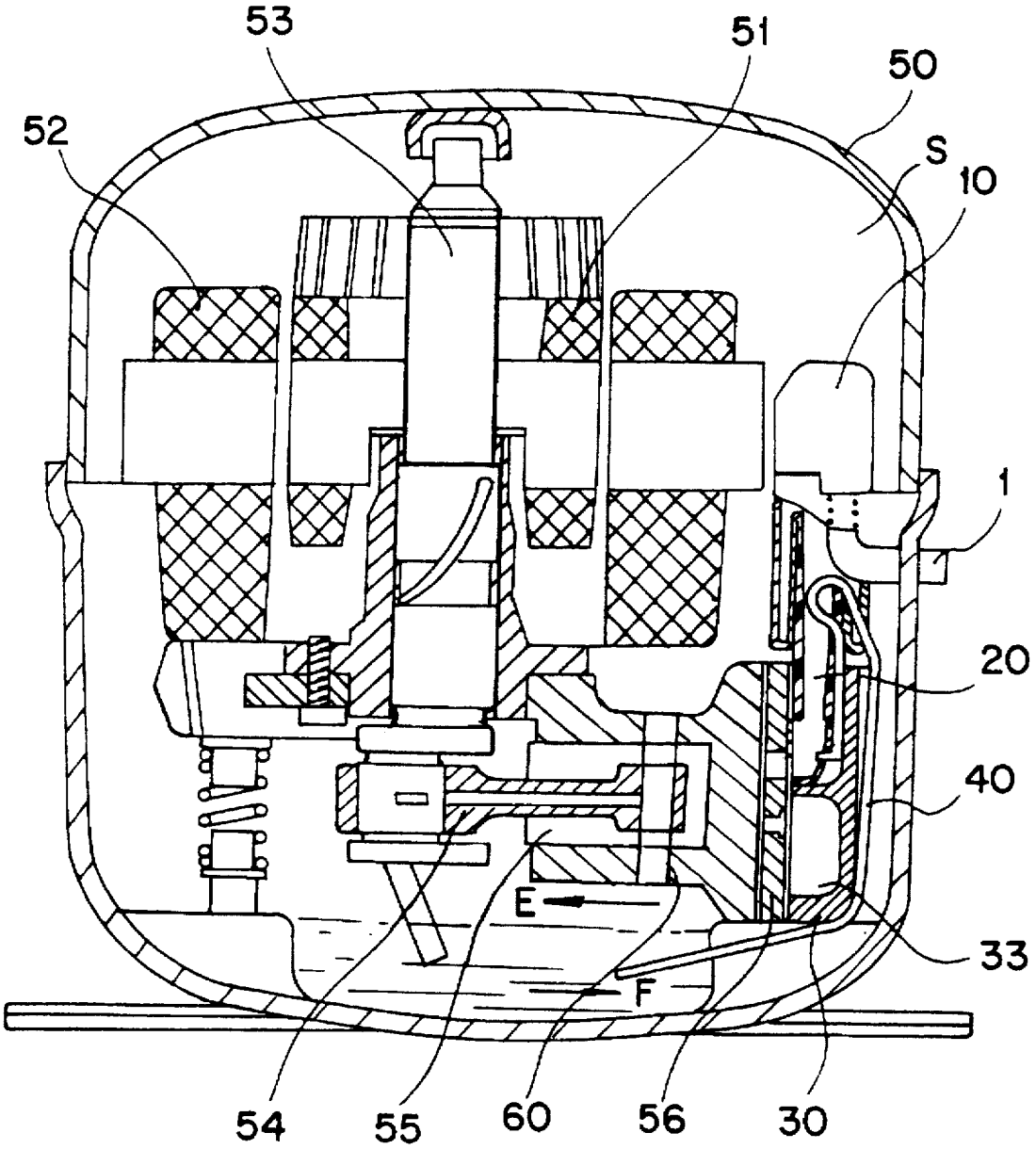
FIG. 4 is a sectional view for schematically illustrating an inner structure of a compressor according to an embodiment of the present invention.

As shown in FIG. 4, reference numeral 50 is a casing body for maintaining a hermetical sealing of a space or chamber S of a compressor and for forming an external appearance thereof.

The compressor 50 is, as illustrated in FIG. 4, provided therein with a stator 52 for receiving a power from an electric power supply means (not shown) to thereby form a magnetic field, a rotor 51 for being rotated by the magnetic field formed at the stator 52, a crankshaft 53 rotated in cooperation with the rotor 51, a connecting rod 54 connected at one end of the crankshaft 53 to thereby convert a rotary movement of the crankshaft 53 to a reciprocating movement, a piston 55 for being connected at the other end thereof to the connecting rod 54 to thereby be reciprocated by the connecting rod 54 and a cylinder block 60 for guiding the piston 55 to be reciprocated.

Furthermore, the body 50 is provided, as illustrated in FIG. 4, at an inner side thereof with a suction muffler 10 for sucking, and attenuating the noise generated by, refrigerant supplied from an evaporator (not shown).

Figure 5:
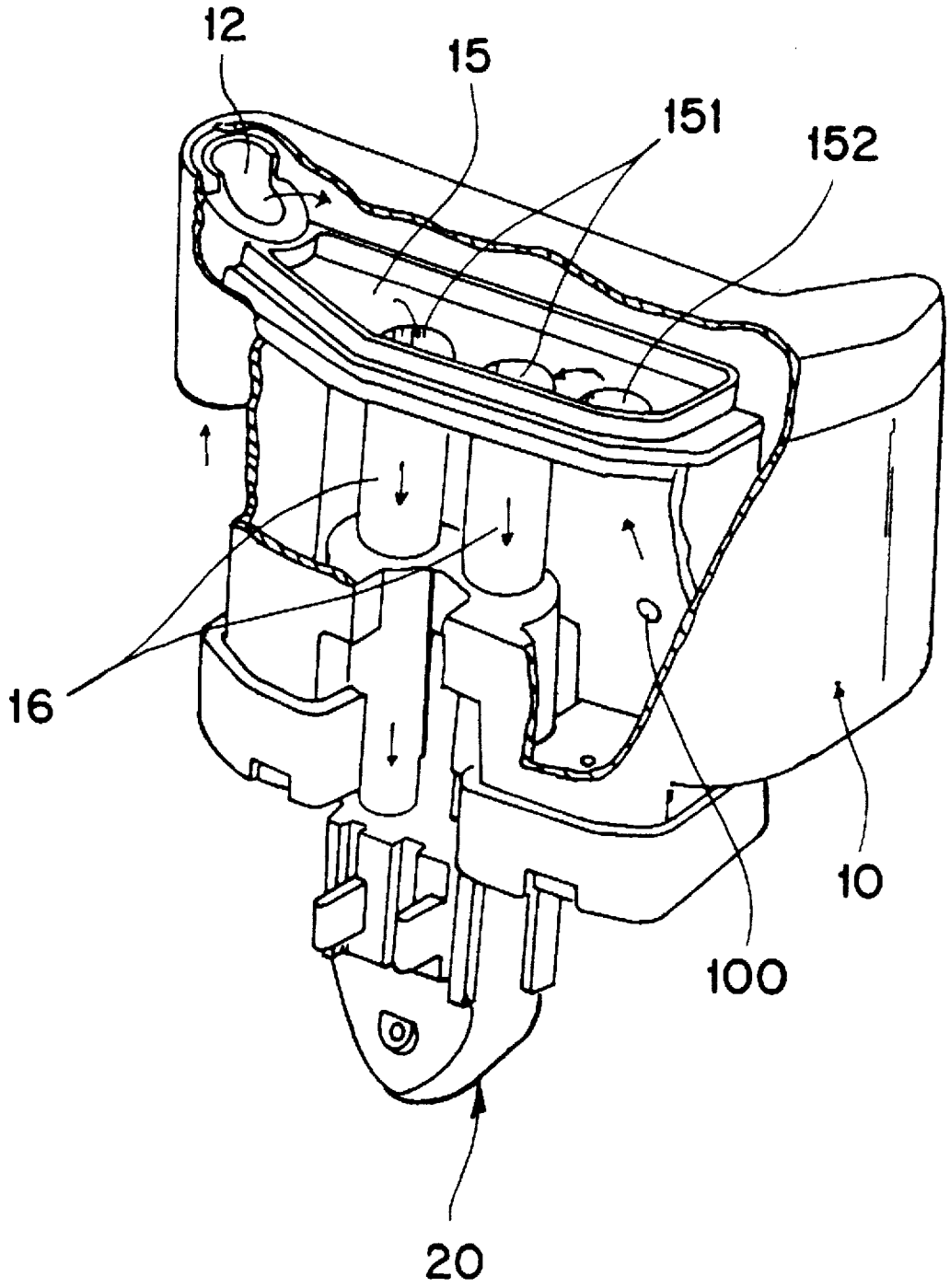
FIG. 5 is a perspective view for illustrating principal parts of FIG. 4.

Meanwhile, the suction muffler 10 is formed, as illustrated in FIG. 5, with a suction inlet 12 for guiding the refrigerant to be sucked therethrough, a suction baffle 15 for indirectly inhibiting the travel of noise when the refrigerant is sucked in through the suction inlet 12 and formed with through holes 151 for conducting the refrigerant, a guide tube 16 connected to an outlet of each through hole 151 to thereby guide the flow of the refrigerant having passed the through hole 151, and a recess 11 (see FIG. 6) for accommodating a base muffler 20 (described later). The suction muffler thus forms an internal suction passage.

Figure 6:
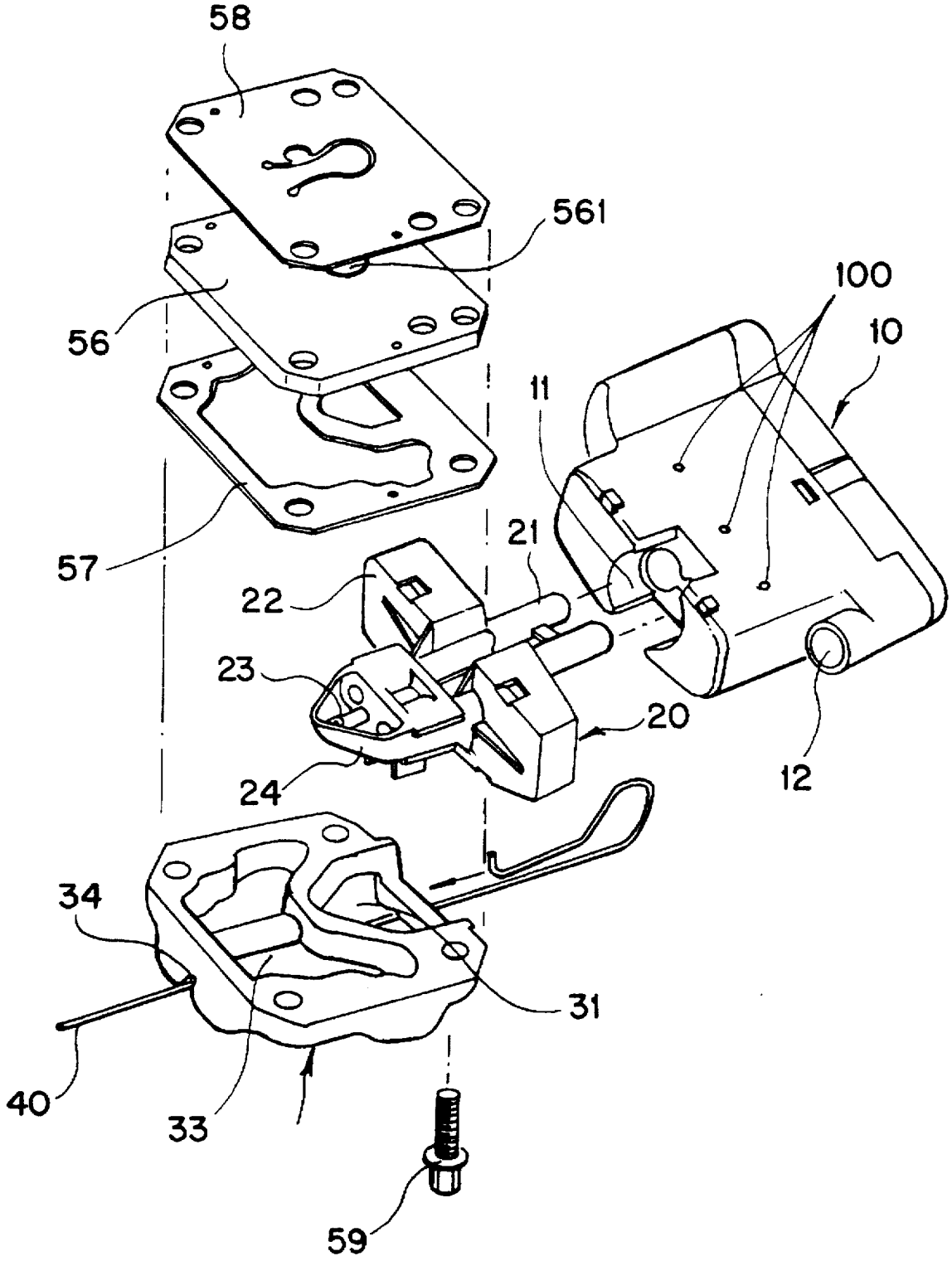
FIG. 6 is a perspective view for illustrating exploded principal parts of FIG. 4.
Figure 7:
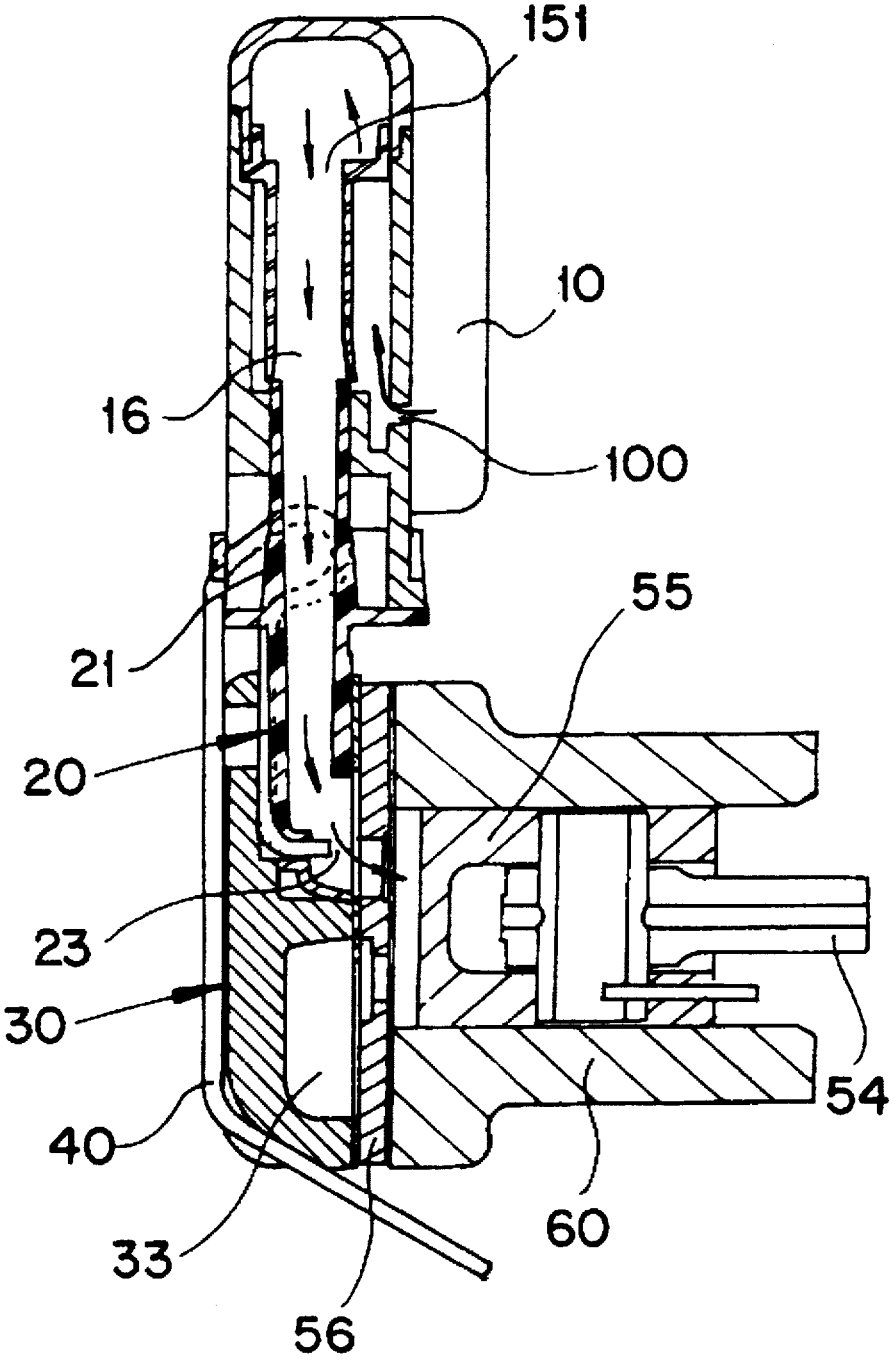
FIG. 7 is an enlarged sectional view for illustrating principal parts of FIG. 4.
Figure 8:
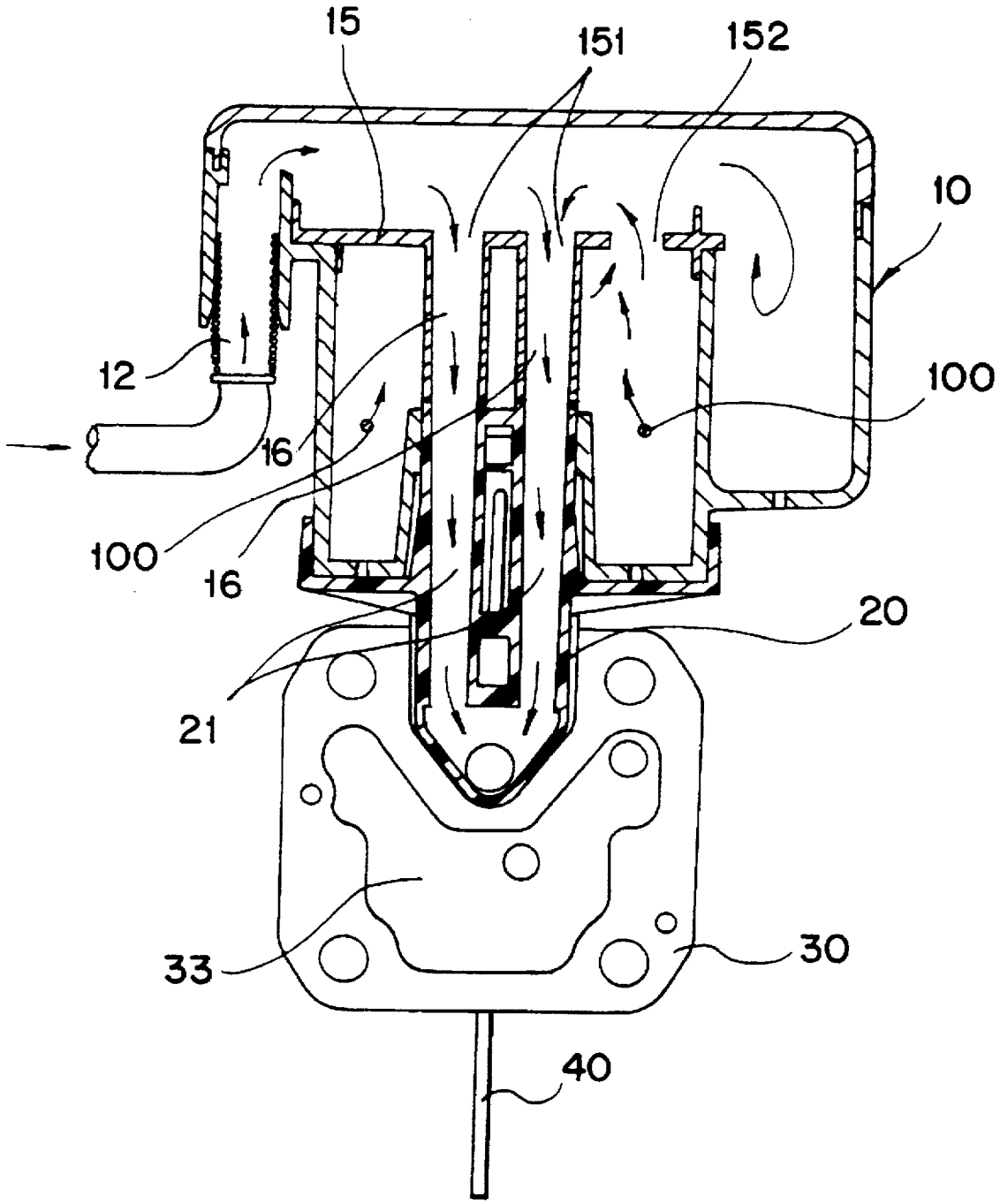
FIG. 8 is another sectional view for illustrating inner structure of principal parts of FIG. 4.

The suction muffler 10 is perforated at a side thereof with more than one external hole 100 at a predetermined spacing in order to communicate the internal suction passage with the space S disposed external to the suction muffler and thereby maintain a vacuum in the suction muffler 10 at an appropriate level, as illustrated in FIGS. 5 and 6.

Therefore, the rotor 51 and the crankshaft 53 can be protected from being excessively loaded and the suction inlet 561 of a valve plate 56 (see FIG. 6) can be prevented from being closed too.

Figure 9:
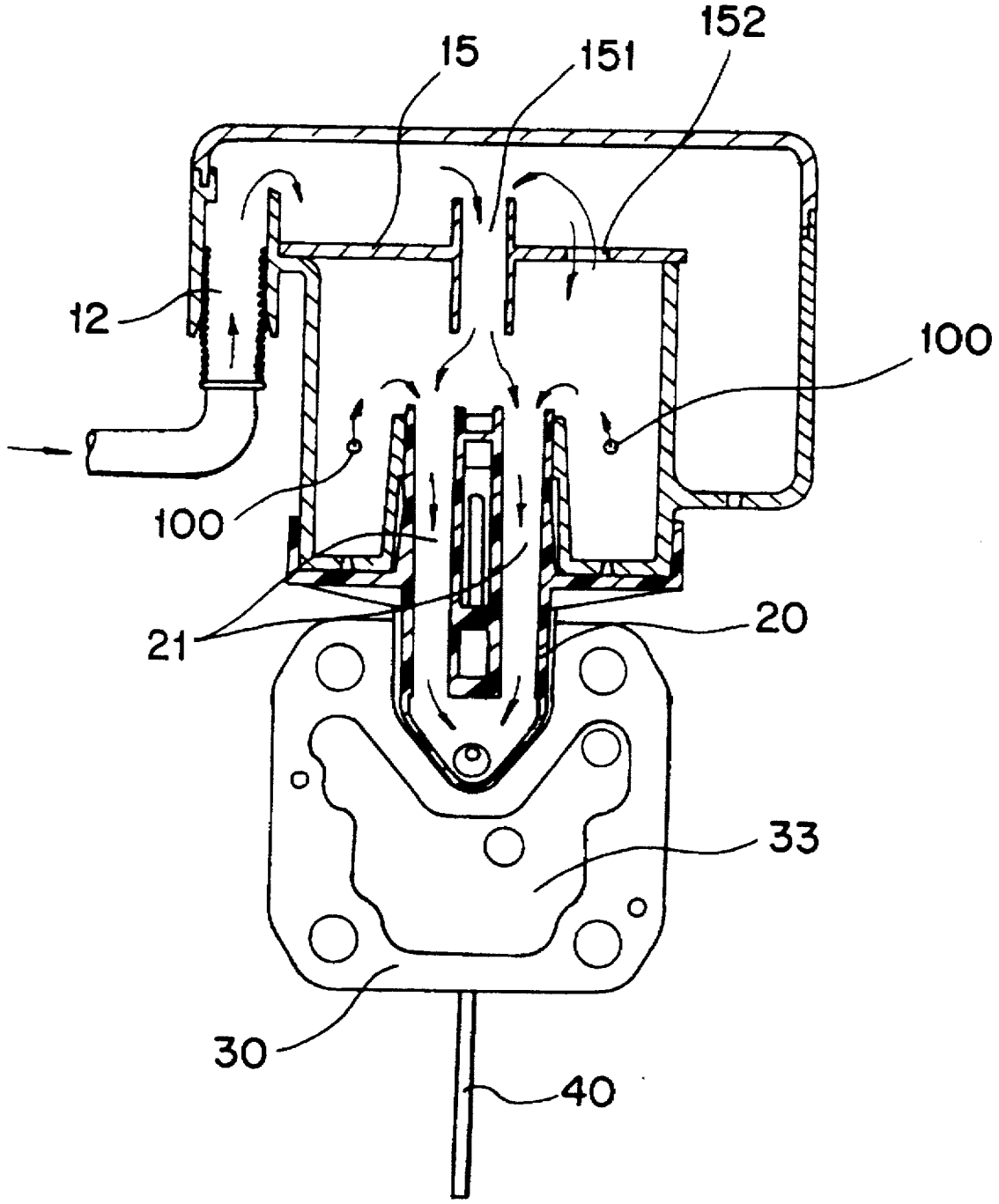
FIG. 9 is a sectional view similar to FIG. 8 for illustrating another embodiment of the present invention.
Figure 10:
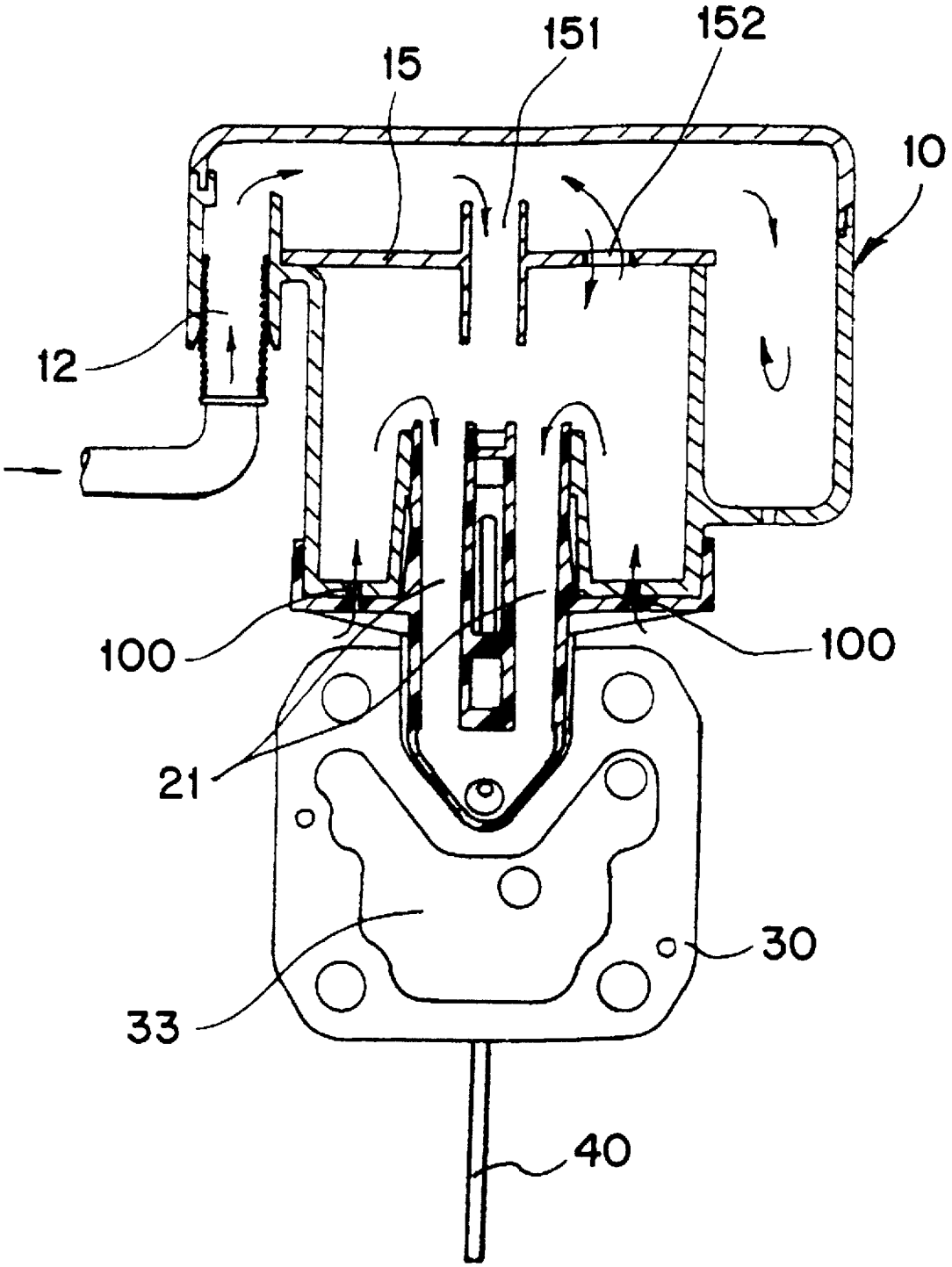
FIG. 10 is a sectional view FIG. 8 for illustrating still another embodiment of the present invention.

Meanwhile, although each external hole 100, as illustrated in FIG. 6, is disposed in a side of the suction muffler 10 and communicates with an inlet of the through-hole 151, this is not taken to be limiting but the holes can be disposed downstream of the through-hole 151 to communicate directly with the insertion unit 21 of the base muffler 20, as illustrated in FIG. 9, or, as illustrated in FIG. 10, can be formed in a bottom area of the suction muffler 10.

In other words, the holes 100 can be placed at any place on the suction muffler 10 as long as the place is good enough to maintain a vacuum in the suction muffler 10.

The suction baffle 15 of the suction muffler 10 is formed, as illustrated in FIG. 5, with a guide hole 152 in order to conduct air from holes 100 to the through holes 151.

Meanwhile, between the cylinder block 60 and the cylinder head 30, there are provided a gasket 57 for maintaining a hermetical sealing, a valve plate 56 centrally formed with a suction inlet 561 and a suction valve plate 58 for opening and closing the suction inlet 561 of the valve plate 56, which are fixedly secured by fastening means such as bolts and the like, as illustrated in FIG. 6.

The cylinder head 30 is formed at an inner side thereof, as illustrated in FIG. 6, with a discharge chamber 33 for discharging therethrough the refrigerant compressed by the reciprocating movement of the piston 55, and a mounting chamber 31 for enabling the base muffler 20 (described later) to be accommodated therein.

Furthermore, the cylinder head 30 is formed at an external surface thereof with a mounting groove 34 so as to easily secure a capillary tube 40 for supplying oil stored in a bottom area of the body 50 into the cylinder block 60 by way of capillary action.

Between the suction muffler 10 and the cylinder head 30, there is disposed the base muffler 20 for guiding the flow of the refrigerant so that heat generated from the stator 52, rotor 51 and the like can be prevented from being transferred to the refrigerant, and, at the same time, enabling the refrigerant having passed the suction muffler 10 to be sucked into the cylinder block 60 through the suction inlet 561 of the valve plate 56.

In other words, the base muffler 20 has a base unit 24 injection-molded of material such as plastic or the like having a low heat transfer coefficient, an insertion unit 21, a body 22 and a suction chamber 23, so that the refrigerant having passed the suction muffler 10 can be guided in its flow, and, at the same time, the heat generated from the stator 52, rotor 51 and the like can be prevented from being transferred to the refrigerant.

Meanwhile, reference numeral 1 in FIG. 4 is a suction tube for guiding the flow of the refrigerant so that the refrigerant supplied from an evaporator (not shown) can be supplied to the suction muffler 10.

Next, the operation of the compressor thus constructed will be described.

First of all, when power is applied from a power supply means (not shown), a magnetic field is caused to form at the stator 52.

The rotor 51 and the crankshaft 53 are rotated by the magnetic field formed at the stator 52, and the rotary movement of the crankshaft 53 is converted to reciprocating movement by the connecting rod 54.

The piston 55 connected to the connecting rod 54 is guided to the cylinder block 60 to thereafter be reciprocated.

At this time, when the piston 55 is moved in an arrowhead direction E illustrated in FIG. 4, the refrigerant is sucked from the evaporator (not shown) through the suction tube 1.

The refrigerant sucked through the suction tube 1 is caused to move toward in arrowhead directions shown in FIGS. 5, 6, 7 and 8.

In other words, the refrigerant having passed the suction tube 1 is guided into the through hole 151 and a guide tube 16 of the suction muffler 10 as illustrated in FIGS. 5, 6, 7 and 8, to thereafter be supplied into the suction chamber 23 at the base muffler 20. The refrigerant supplied to the suction chamber 23 is sucked into the cylinder block 60 through the suction inlet 561 in the valve plate 56.

In the compressor according to the present invention, there are holes 100 in the suction muffler 10, so that residual refrigerant remaining in the body 50 can be sucked into the suction muffler 10 through the holes 100 during the intake stroke thereof.

In other words, when the piston 55 is driven in the arrowhead direction illustrated in FIG. 4, refrigerant residually remaining in the body 50 is sucked into the suction muffler 10 through the holes 100 to thereby maintain a vacuum in the suction muffler 10 at an appropriate level.

Consequently, there is no such thing as an occurrence where the crankshaft 53 and the piston 55 are excessively loaded due to an excessive vacuumized state in the suction muffler, as is noticed in the prior art.

Now, the above-mentioned process is further described in detail.

The refrigerant supplied from an evaporator (not shown) and part of the refrigerant remaining in the body 50 are supplied into the suction muffler 10 to thereby cause a vacuum in the suction muffler 10 to be maintained at an appropriate level without being excessively vacuumized, so that the piston 55 and the crankshaft 53 are not excessively over-loaded and at the same time, the suction inlet 561 at the valve plate is prevented from being closed early by the suction valve 58 as well.

Furthermore, the piston 55 and the crankshaft 53 are smoothly driven without being excessively over-loaded thereby preventing the suction inlet 561 of the valve plate 56 from being early closed, so that more refrigerant can be sucked into the cylinder block 60.

The refrigerant sucked into the cylinder block 60 is driven in the right-hand direction F illustrated in FIG. 4, and is easily compressed to high pressure, and discharged into the discharge chamber 33 of the cylinder head 30 and then is supplied into a condenser (not shown) through a discharge tube.

In other words, because the suction muffler 10 is perforated with external holes 100, the suction muffler can maintain a vacuum therein at an appropriate level during an intake stroke of the compressor, so that the crankshaft 53, the piston 55 and the like are prevented from being excessively over-loaded and the suction inlet 561 of the valve plate 56 is also prevented from being closed too early to enable a maximum amount of refrigerant to be sucked into the cylinder block 60 easily and smoothly.

Furthermore, the refrigerant easily and smoothly sucked into the cylinder block 60 is compressed to high pressure during the intake stroke of the compressor and supplied to a condenser (not shown), thereby enabling an improved cooling efficiency and enhancing reliability of the product.

As is apparent from the foregoing, there is an advantage in the compressor according to the present invention, in that a suction muffler is provided with holes to thereby enable the suction muffler to maintain vacuum at an appropriate level and to prevent the crankshaft and the piston from being excessively over-loaded and to avoid the suction inlet from being closed earlier than would otherwise occur, such that the compressor is improved in its compressing efficiency to improve a cooling efficiency and to enhance reliability of the product as well.

The foregoing description of the preferred embodiments has been presented for the purpose of illustration and description. It is not intended to limit the scope of this invention. Many modifications and variations are possible in light of the above teaching. It should be noted that the present invention can be applied to all kinds of the apparatus within the scope of the above presentation.

What is claimed is:

1. A compressor comprising:

a casing forming an interior space;

a motor disposed in the space;

a crankshaft driven by the motor;

a cylinder block disposed in the space, the cylinder block forming a bore;

a piston mounted for reciprocation in the bore and connected to the crankshaft to be reciprocated thereby for sucking fluid into the bore and then compressing the sucked-in fluid;

a cylinder head mounted to the cylinder block at an end of the bore for conducting sucked fluid to the bore to be compressed therein, and conducting compressed fluid from the bore;

a valve plate disposed between the bore and cylinder head for controlling the flow of fluid to and from the bore;

a base muffler disposed between a suction muffler and the cylinder head for conducting sucked fluid to the cylinder head; and the suction muffler defining a fluid passage communicating a fluid source with the base muffler for supplying sucked fluid to the base muffler, the suction muffler including external holes on the body of the suction muffler communicating the fluid passage with the interior space of the casing for communicating suction pressure in the fluid passage with the space to reduce the suction load at the bore and valve plate.

2. The compressor according to claim 1 wherein the valve plate includes a suction valve which opens in response to suction applied by the piston.

3. The compressor according to claim 1 wherein the suction muffler comprises a suction inlet for receiving fluid, a suction baffle including a through-hole through which the fluid from the suction inlet is sucked, a guide tube connected to an outlet of the through-hole for conducting fluid that has passed through the through-hole, and a recess for receiving a portion of the base muffler.

4. The compressor according to claim 3 wherein the suction baffle includes a guide hole communicating the external holes with an inlet of the through-hole.

5. The compressor according to claim 1 wherein there is a plurality of the through-holes formed in the suction baffle, the through-holes formed in a central region of the suction baffle.

6. The compressor according to claim 1 wherein the external holes are formed in a portion of the fluid passage disposed downstream of the through-hole.

* * * * *